US011473772B2

(12) United States Patent
Wang

(10) Patent No.: US 11,473,772 B2
(45) Date of Patent: Oct. 18, 2022

(54) QUICK ASSEMBLING STRUCTURE FOR CEILING FAN WITH LAMP

(71) Applicant: AIR COOL INDUSTRIAL CO., LTD., Taichung (TW)

(72) Inventor: Cliff Wang, Taichung (TW)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 95 days.

(21) Appl. No.: 17/172,053

(22) Filed: Feb. 9, 2021

(65) Prior Publication Data

US 2022/0252252 A1 Aug. 11, 2022

(51) Int. Cl.

| | |
|---|---|
| ***F21V 21/03*** | (2006.01) |
| ***F21V 33/00*** | (2006.01) |
| ***F21S 8/00*** | (2006.01) |
| ***F04D 25/08*** | (2006.01) |

(52) U.S. Cl.

CPC ..... *F21V 33/0096* (2013.01); *F04D 25/088* (2013.01); *F21S 8/036* (2013.01)

(58) Field of Classification Search

CPC ..... F21V 33/0096; F21V 21/03; F21V 17/14; F21V 17/18; F04D 25/088

See application file for complete search history.

(56) References Cited

U.S. PATENT DOCUMENTS

| | | | | |
|---|---|---|---|---|
| 6,350,045 | B1 * | 2/2002 | Pearce | F21V 17/164 362/438 |
| 2012/0106177 | A1 * | 5/2012 | Blankestijn | F21V 19/04 362/382 |
| 2018/0058476 | A1 * | 3/2018 | Jones | H01R 13/6278 |
| 2020/0208809 | A1 * | 7/2020 | Zhang | F21S 8/063 |

* cited by examiner

*Primary Examiner* — Julie A Bannan

(74) *Attorney, Agent, or Firm* — Pai Patent & Trademark Law Firm; Chao-Chang David Pai

(57) ABSTRACT

A quick assembling structure for a ceiling fan with a lamp includes a first seat and a second seat. A first peripheral wall of the first seat is radially provided with a plurality of positioning members. The second seat has a second peripheral wall to be sleeved onto the first peripheral wall. The second peripheral wall has recesses that are recessed radially and correspond to the respective positioning members. The second peripheral wall is formed with guide holes corresponding to and communicating with the respective recesses. Through the positioning members to be inserted into the recesses and the guide holes and tightened in the guide holes, the first peripheral wall of the first seat is connected to the second peripheral wall of the second seat so as to assemble the ceiling fan and the lamp quickly.

8 Claims, 9 Drawing Sheets

QUICK ASSEMBLING STRUCTURE FOR CEILING FAN WITH LAMP

FIELD OF THE INVENTION

The present invention relates to a ceiling fan with a lamp, and more particularly to a quick assembling structure for a ceiling fan with a lamp.

BACKGROUND OF THE INVENTION

Conventional ceiling fans are mostly fixed to the ceiling. In order to save the installation space of a lamp, a ceiling fan is usually combined with a lamp under the ceiling fan. With the setting of the lamp, the ceiling fan has the lighting effect. However, the lamp is integrally connected to the ceiling fan, so that users cannot change the style of the lamp according to different preferences. It is also impossible to change the lighting brightness of the lamp according to different usage requirements, which causes great inconvenience in use.

An improved ceiling fan with a lamp is disclosed in Taiwan Patent Application No. 102207926 titled "Connecting Cap Structure for Ceiling Fan with Lamp". As shown in FIG. 1, a connecting cap body 3 is connected between a fixing member 1 of the ceiling fan and a lamp 2. The connecting cap body 3 is provided with an inner groove seat 4. The edge of the inner groove seat 4 extends outward and is provided with a bottom plate 5. The bottom plate 5 is formed with a plurality of locking grooves 6. One end of each locking groove 6 is formed with a positioning hole 7. The screws 8 of the lamp 2 respectively pass through the corresponding positioning holes 7 of the connecting cap body 3, and the screws 8 are moved to the corresponding locking grooves 6. Through the screws 8 of the lamp 2 to be positioned in the locking grooves 6, the fixing member 1 of the ceiling fan and the lamp 2 are combined and fixed. However, if the ceiling fan runs and vibrates for a long time, it is easy to cause the screws 8 to loosen or displace. The screws 8 may move from the locking grooves 6 to the positioning holes 7 and even fall off from the positioning holes 7, causing the lamp 2 to fall. It is not safe for use. Accordingly, the inventor of the present invention has devoted himself based on his many years of practical experiences to solve these problems.

SUMMARY OF THE INVENTION

The primary object of the present invention is to provide a quick assembling structure for a ceiling fan with a lamp, which improves the assembly convenience and assembly safety for a ceiling fan.

In order to achieve the above object, the present invention provides a quick assembling structure for a ceiling fan with a lamp, mounted to the ceiling fan. The quick assembling structure comprises a first seat and a second seat. The first seat has a first peripheral wall. The first peripheral wall is radially provided with a plurality of positioning members. The positioning members are arranged at intervals. The second seat has a second peripheral wall to be sleeved onto the first peripheral wall. The second seat has an opening on a receiving side of the second peripheral wall. The second peripheral wall has recesses that are recessed radially and correspond to the respective positioning members. Each of the recesses is an axial through recess. One side of each of the recesses communicates with the opening for positioning and insertion of the positioning members. The second peripheral wall is formed with guide holes corresponding to the respective recesses. Another side of each of the recesses communicates with a corresponding one of the guide holes. The guide holes each radially extend and taper toward a tightening end along a guide direction for guiding the positioning members. The tightening ends of the guide holes are configured to tighten the positioning members. The second peripheral wall is further formed with locking grooves each on one side of the respective guide holes adjacent to the opening corresponding to the positioning members. The locking grooves are recessed from the guide holes toward the opening so that the locking grooves are configured to retain the positioning members.

In the quick assembling structure provided by the present invention, through the positioning members to be inserted into the recesses and the guide holes and tightened at the tightening ends of the guide holes, the first peripheral wall of the first seat is connected to the second peripheral wall of the second seat so as to assemble the ceiling fan and the lamp quickly.

DETAILED DESCRIPTION OF THE PREFERRED EMBODIMENTS

Embodiments of the present invention will now be described, by way of example only, with reference to the accompanying drawings.

Figure 1:
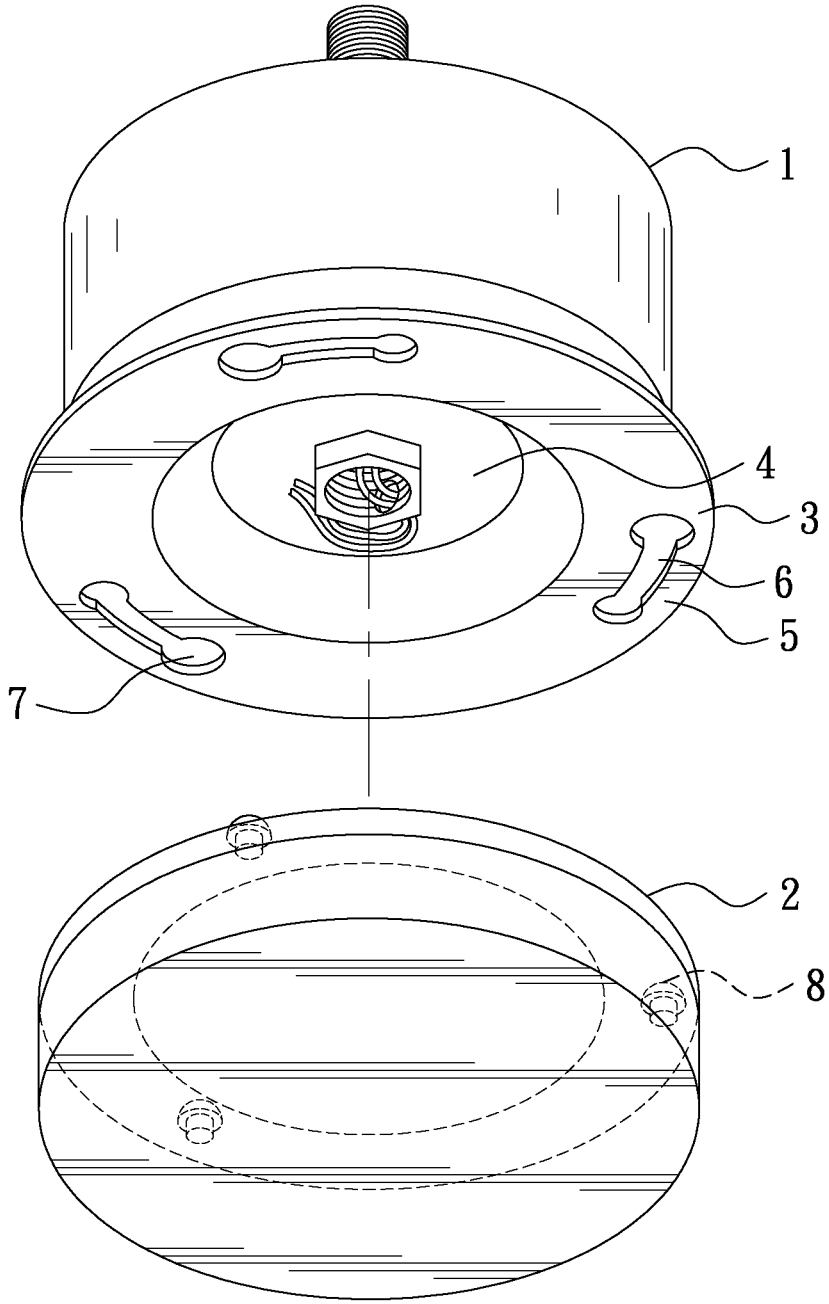
FIG. 1 is an exploded view of a conventional ceiling fan with a lamp.
Figure 2:
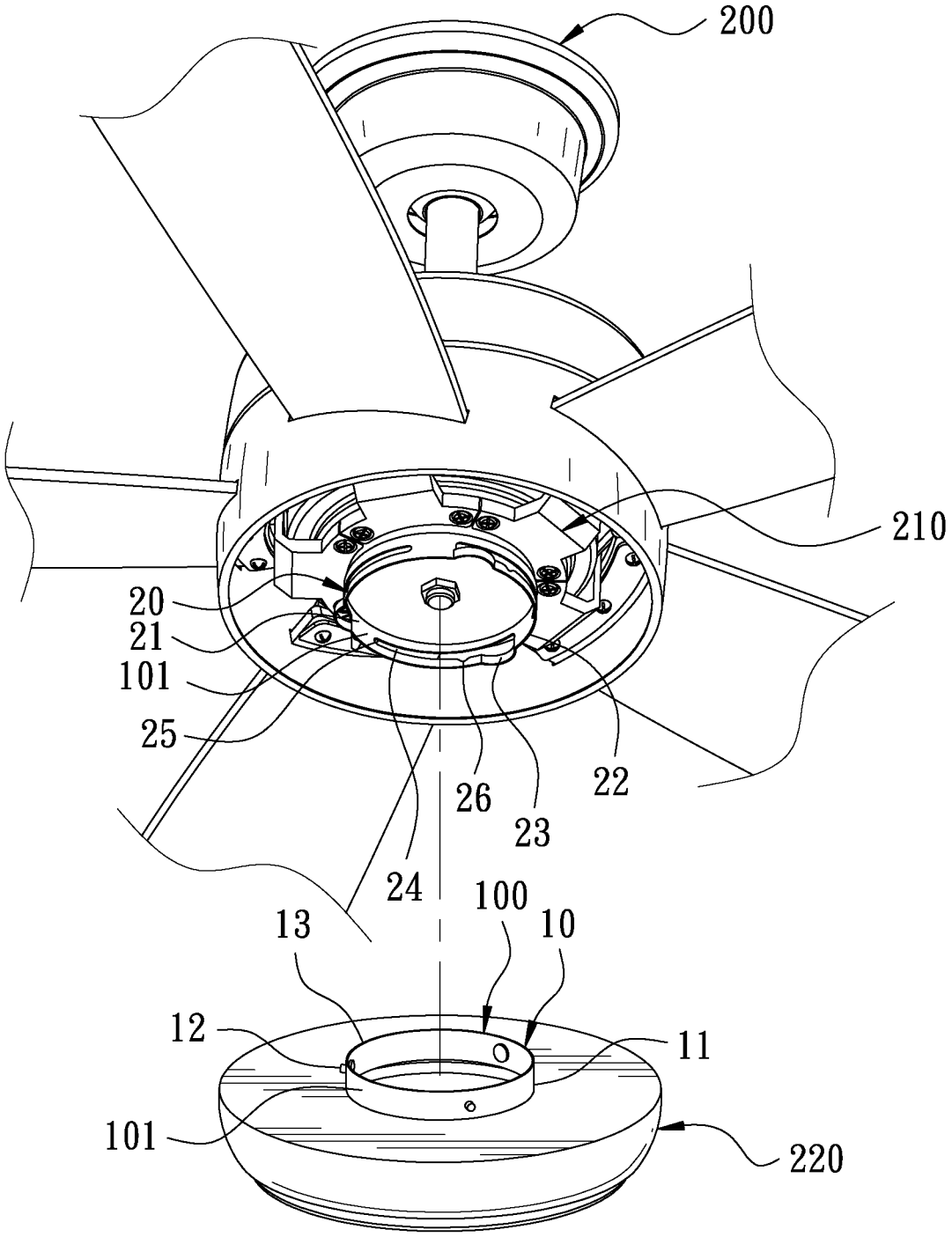
FIG. 2 is an exploded view in accordance with a first embodiment of the present invention.
Figure 3:
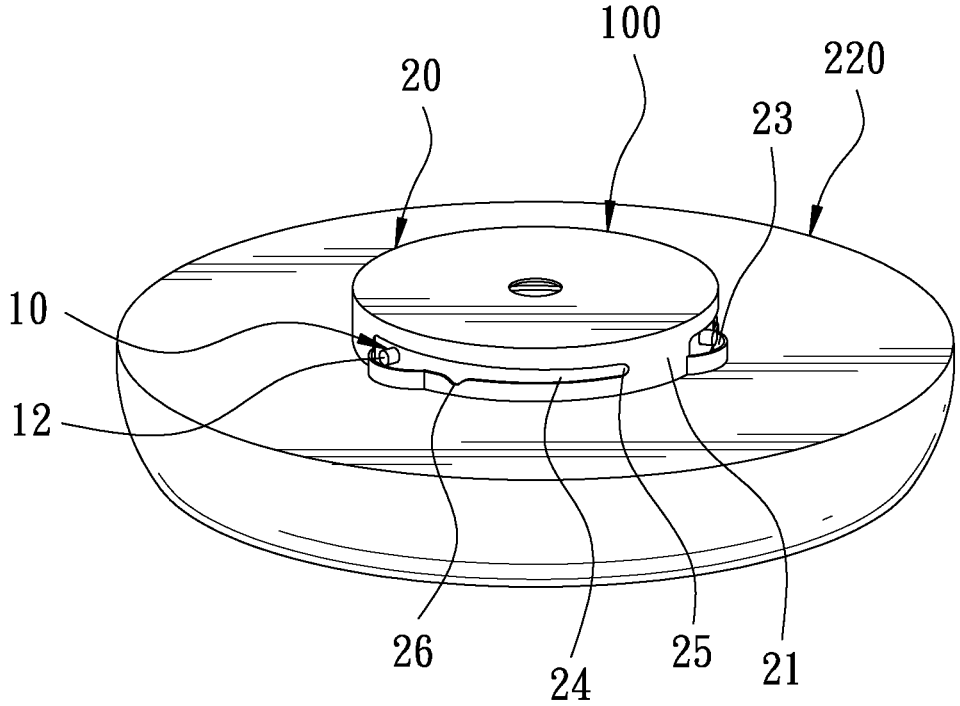
FIG. 3 is a partial perspective view in accordance with the first embodiment of the present invention.

FIG. 2 is a perspective view in accordance with a first embodiment of the present invention. FIG. 3 is a partial perspective view in accordance with the first embodiment of the present invention. The present invention discloses a quick assembling structure 100 for a ceiling fan with a lamp, which is mounted to a ceiling fan 200. In the first embodiment of the present invention, the ceiling fan 200 has a fixing unit 210 and a lamp 220. The fixing unit 210 can be a ceiling fan fixing structure or a ceiling fan fixing holder or a ceiling fan housing or a ceiling fan motor housing. The quick assembling structure 100 has two seats 101. One seat 101 may be fixed to the fixing unit 210, and the other seat 101 may be fixed to the lamp 220. The seats 101 are defined as a first seat 10 and a second seat 20, respectively.

The first seat 10 is fixed to the lamp 220. The first seat 10 has a first peripheral wall 11. In the first embodiment of the present invention, the first seat 10 is a hollow seat. The first peripheral wall 11 is an annular wall. The first peripheral wall 11 is radially provided with a plurality of positioning members 12. The positioning members 12 extend outwardly from the outer side of the first peripheral wall 11. The positioning members 12 are arranged at intervals and equidistant. The positioning members 12 are located on the same plane. The first seat 10 has a receiving opening 13 on a receiving side of the first peripheral wall 11.

The second seat 20 is fixed to the fixing unit 210. The second seat 20 has a second peripheral wall 21 to be sleeved onto the first peripheral wall 11. In the first embodiment of the present invention, when the second peripheral wall 21 is sleeved onto the first peripheral wall 11, the second peripheral wall 21 is located outside the first peripheral wall 11. The second seat 20 is a hollow seat. The second peripheral wall 21 is an annular wall. The second seat 20 has an opening 22 on a receiving side of the second peripheral wall 21. The second peripheral wall 21 has recesses 23 that are recessed radially and correspond to the respective positioning members 12. The recesses 23 are recessed outwardly from the inner side of the second peripheral wall 21 of the second seat 20. Each of the recesses 23 is an axial through recess. One side of each of the recesses 23 communicates with the opening 22 for positioning and insertion of the positioning members 12. The second peripheral wall 21 is formed with guide holes 24 corresponding to the respective recesses 23. The other side of each of the recesses 23 communicates with a corresponding one of the guide holes 24. The guide holes 24 each radially extend and taper toward a tightening end 25 along a guide direction. The tightening ends 25 of the guide holes 24 corresponds in size to the positioning members 12, so that the guide holes 24 can guide the positioning members 12. The tightening ends 25 of the guide holes 24 are configured to tighten the positioning members 12. In addition, the second peripheral wall 21 is further formed with locking grooves 26 each on one side of the respective guide holes 24 adjacent to the opening 22 corresponding to the positioning members 12. The locking grooves 26 are recessed from the guide holes 24 toward the opening 22 so that the locking grooves 26 are configured to retain the positioning members 12.

Figure 4:
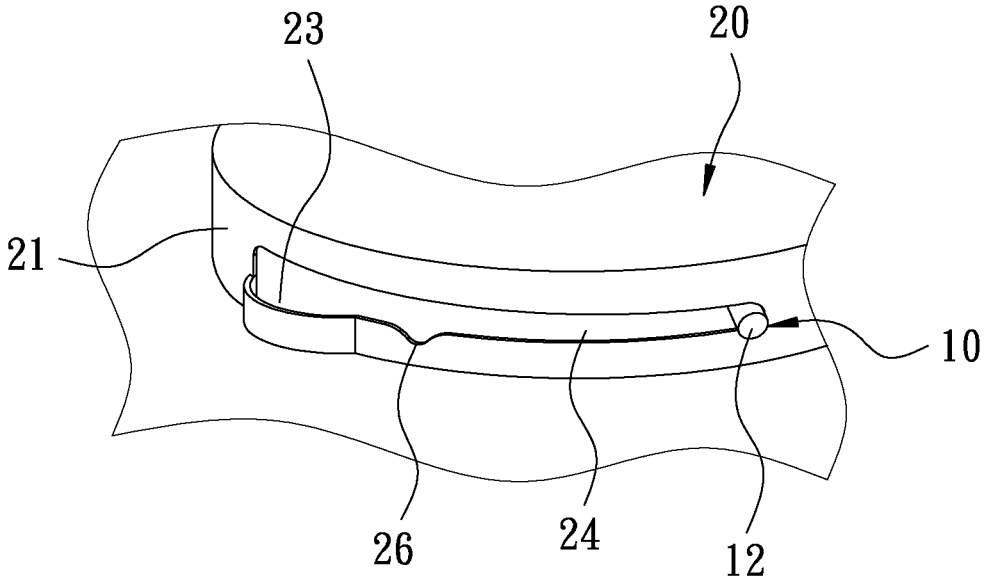
FIG. 4 is a partial enlarged view in accordance with the first embodiment of the present invention, showing that the positioning member is positioned in the guiding hole.

FIG. 4 is a partial enlarged view in accordance with the first embodiment of the present invention. When the quick assembling structure 100 is to be assembled, the first seat 10 is first moved toward the opening 22 of the second seat 20, so that the first peripheral wall 11 of the first seat 10 is fitted to the second peripheral wall 21 of the second seat 20, and the positioning members 12 of the first peripheral wall 11 are inserted into the corresponding recesses 23 and the guide holes 24, respectively. At this time, the positioning members 12 of the first peripheral wall 11 are radially moved along the guide direction toward the tightening ends 25 of the guide holes 24 so that the positioning members 12 are tightened at the tightening ends 25, respectively. The first peripheral wall 11 of the first seat 10 and the second peripheral wall 21 of the second seat 20 are rotatably engaged with each other, so that the fixing unit 210 and the lamp 220 are combined and fixed to quickly complete the assembly of the lamp 220 and the ceiling fan 200.

Figure 5:
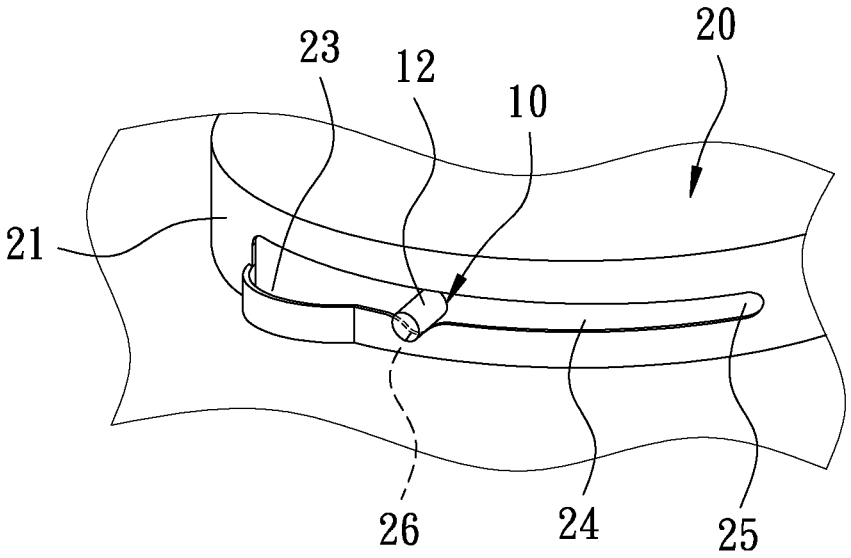
FIG. 5 is a partial enlarged view in accordance with the first embodiment of the present invention, showing that the positioning member is retained in the locking groove.
Figure 6:
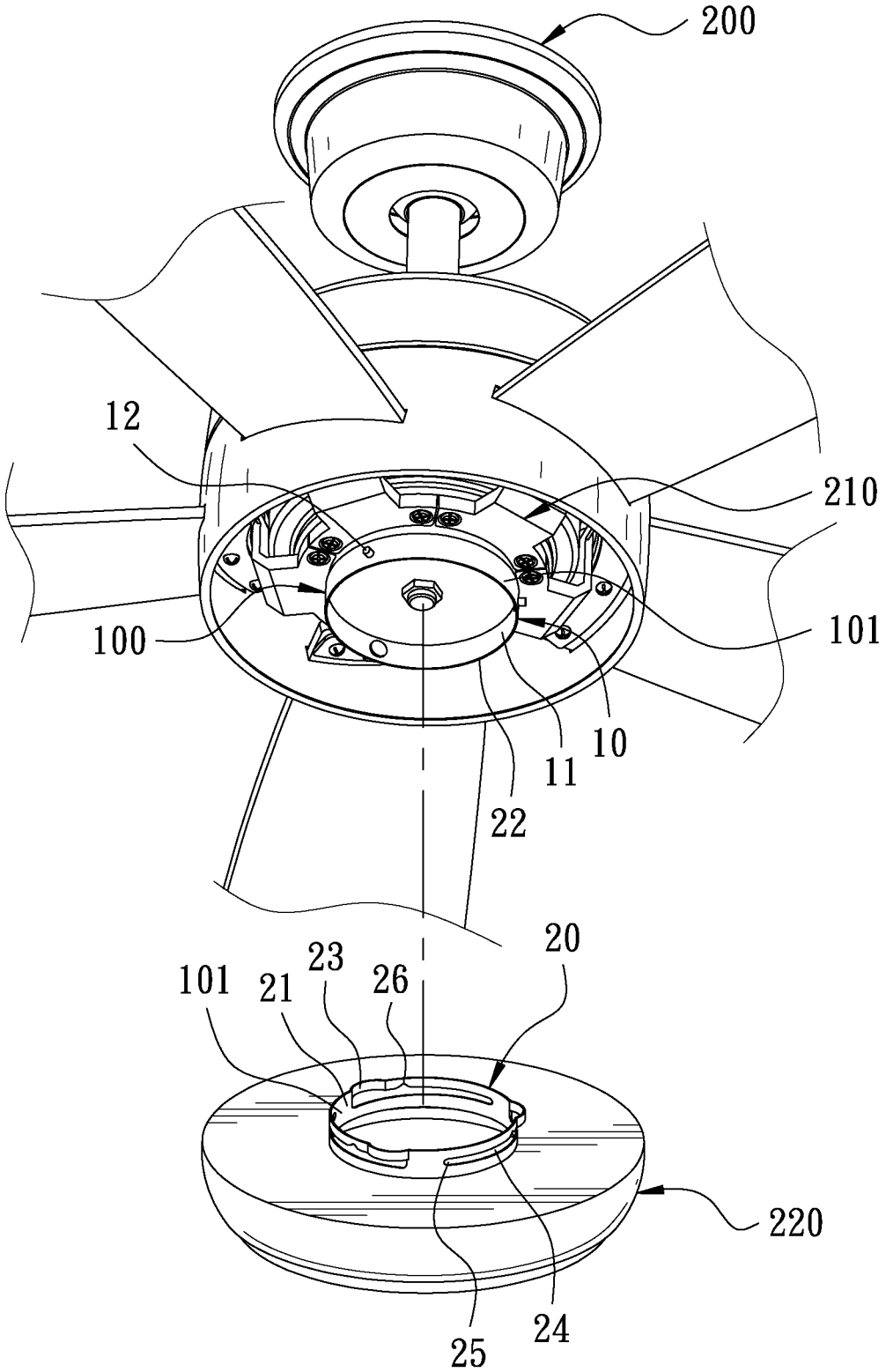
FIG. 6 is an exploded view in accordance with a second embodiment of the present invention.
Figure 7:
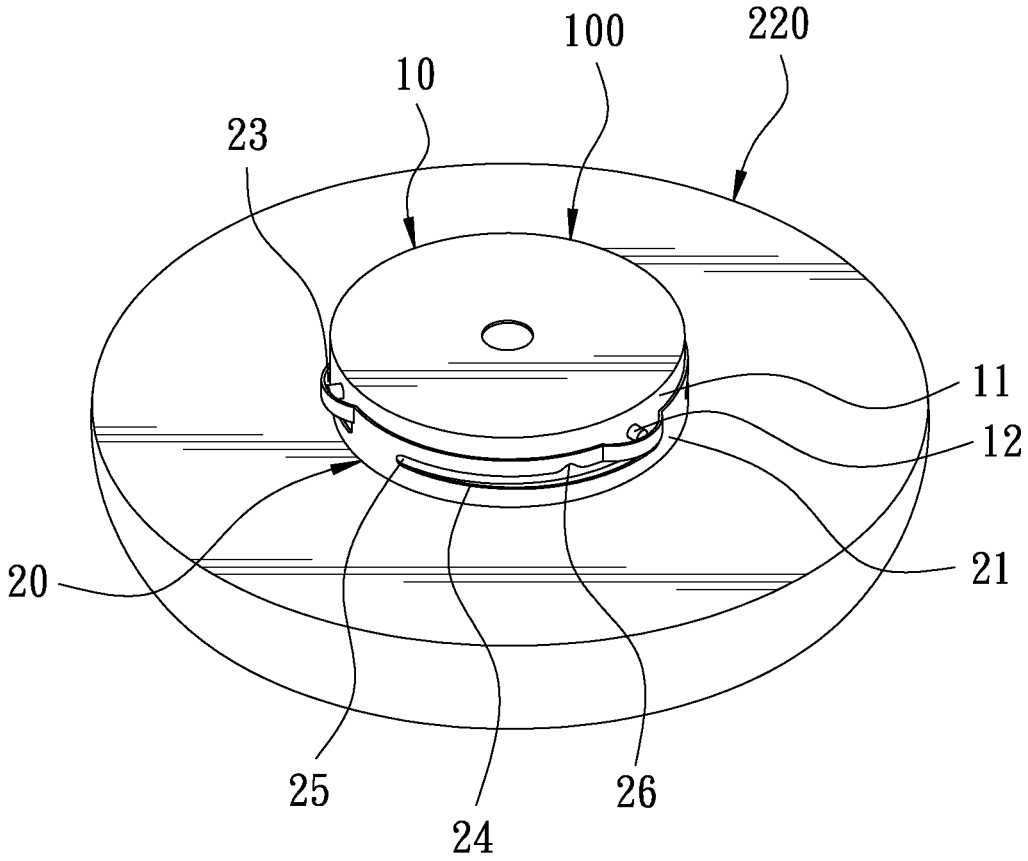
FIG. 7 is a partial perspective view in accordance with the second embodiment of the present invention.
Figure 8:
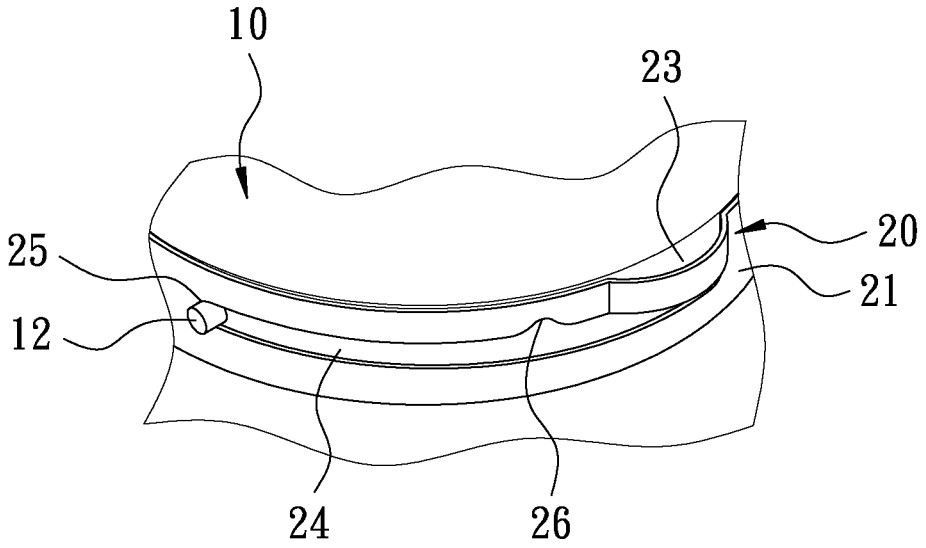
FIG. 8 is a partial enlarged view in accordance with the second embodiment of the present invention, showing that the positioning member is positioned in the guiding hole.
Figure 9:
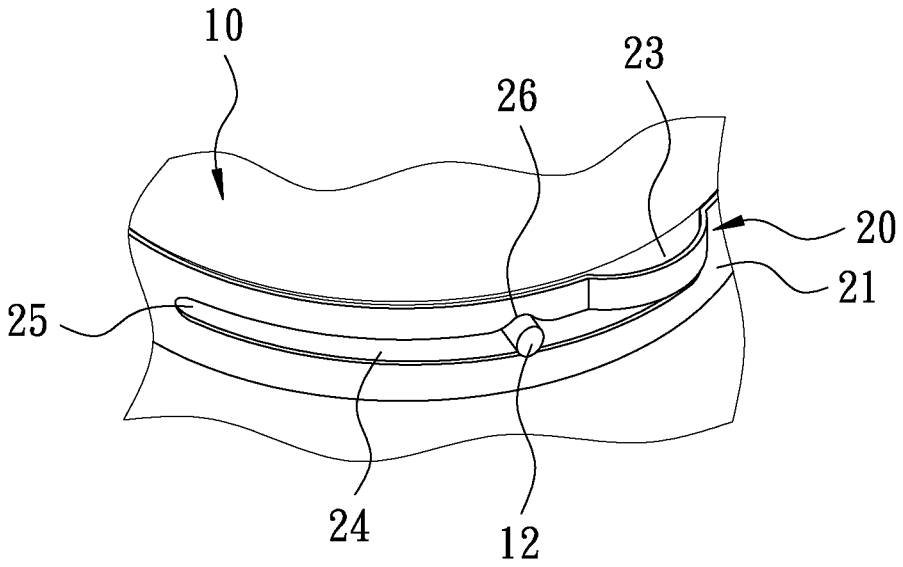
FIG. 9 is a partial enlarged view in accordance with the second embodiment of the present invention, showing that the positioning member is retained in the locking groove.

FIG. 5 is a partial enlarged view in accordance with the first embodiment of the present invention. If the quick assembling structure 100 is to be disassembled or replaced, the first seat 10 with the lamp 220 is rotated in the opposite direction. The positioning members 12 are moved toward the recesses 23 in the direction opposite to the guide direction to be out of the guide holes 24 and the recesses 23, so that the first seat 10 is separated from the second seat 20, and the lamp 220 is also separated from the fixing unit 210. In this way, the lamp 220 can be easily replaced.

It is worth mentioning that if the ceiling fan 200 runs and vibrates for a long time, it is easy to cause the positioning members 12 to loosen or displace, resulting in that the positioning members 12 are moved from the tightening ends 25 of the guide holes 24 towards the recesses 25. At this time, the positioning members 12 can be retained in the locking grooves 26 in the guide holes 24 to prevent the positioning members 12 from moving to the recesses 23 and falling off. This prevents the first seat 10 from being separated from the second seat 20, causing the lamp 220 to fall. The present invention improves the safety of assembly effectively.

FIGS. 6-9 are an exploded view, a partial perspective view and partial enlarged views in accordance with a second embodiment of the present invention. The second embodiment of the present invention is different from the aforementioned first embodiment in that the first seat 10 is fixed to the fixing unit 210 and the second seat 20 is fixed to the lamp 220. The positioning members 12 of the first seat 10 are inserted into the recesses 23 and the guide holes 24 of the second seat 20, and are tightened at the tightening ends 25 of the guide holes 24. The first peripheral wall 11 of the first seat 10 and the second peripheral wall 21 of the second seat 20 can be rotatably locked and fixed, so that the fixing unit 210 and the lamp 220 are combined and fixed. The application range of the present invention is more extensive to increase the practicability of use.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A quick assembling structure for a ceiling fan with a lamp, mounted to the ceiling fan, comprising:

a first seat, having a first peripheral wall, the first peripheral wall being radially provided with a plurality of positioning members, the positioning members being arranged at intervals;

a second seat, having a second peripheral wall to be sleeved onto the first peripheral wall, the second seat having an opening on a receiving side of the second peripheral wall, the second peripheral wall having recesses that are recessed radially and correspond to the respective positioning members, each of the recesses being an axial through recess, one side of each of the recesses communicating with the opening for positioning and insertion of the positioning members, the second peripheral wall being formed with guide holes corresponding to the respective recesses, another side of each of the recesses communicating with a corresponding one of the guide holes, the guide holes each radially extending and tapering toward a tightening end along a guide direction for guiding the positioning members, the tightening ends of the guide holes being configured to tighten the positioning members, the second peripheral wall being formed with locking grooves each on one side of the respective guide holes adjacent to the opening corresponding to the positioning members, the locking grooves being recessed from the guide holes toward the opening so that the locking grooves are configured to retain the positioning members;

thereby, through the positioning members to be inserted into the recesses and the guide holes and tightened at the tightening ends of the guide holes, the first peripheral wall of the first seat being connected to the second peripheral wall of the second seat so as to assemble the ceiling fan and the lamp quickly.

2. The quick assembling structure as claimed in claim 1, wherein the first seat is a hollow seat, and the second seat is a hollow seat.

3. The quick assembling structure as claimed in claim 1, wherein the first peripheral wall is an annular wall, the second peripheral wall is an annular wall, when the second peripheral wall is sleeved onto the first peripheral wall, the second peripheral wall is located outside the first peripheral wall.

4. The quick assembling structure as claimed in claim 3, wherein the positioning members extend outwardly from an outer side of the first peripheral wall, and the recesses are recessed outwardly from an inner side of the second peripheral wall of the second seat.

5. The quick assembling structure as claimed in claim 1, wherein the tightening ends of the guide holes corresponds in size to the positioning members.

6. The quick assembling structure as claimed in claim 1, wherein the first seat has a receiving opening on a receiving side of the first peripheral wall.

7. The quick assembling structure as claimed in claim 1, wherein the positioning members are located on a same plane.

8. The quick assembling structure as claimed in claim 1, wherein the positioning members are equidistant.

* * * * *